United States Patent [19]

Olsen et al.

[11] Patent Number: 4,632,262

[45] Date of Patent: Dec. 30, 1986

[54] CRANE UNDECKING ARRANGEMENT

[75] Inventors: David W. Olsen, Palo; Leroy L. Wittman, Marion; Marvin E. Evenson, Cedar Rapids; Gary W. Kappel, Ely, all of Iowa

[73] Assignee: FMC Corporation, Chicago, Ill.

[21] Appl. No.: 744,650

[22] Filed: Jun. 13, 1985

Related U.S. Application Data

[63] Continuation of Ser. No. 487,629, Apr. 22, 1983, abandoned.

[51] Int. Cl.[4] ..... B66C 23/78

[52] U.S. Cl. ..... 212/189; 280/764.1; 280/765.1

[58] Field of Search ..... 280/764–765; 212/189

[56] References Cited

U.S. PATENT DOCUMENTS

| | | | |
|---|---|---|---|
| 1,873,433 | 8/1932 | Larsen | 212/189 |
| 3,836,012 | 9/1974 | Grider et al. | 212/189 |
| 4,241,803 | 12/1986 | Lauber | 212/189 |
| 4,245,855 | 1/1981 | Larson | 212/189 |
| 4,273,244 | 6/1981 | Jensen et al. | 212/189 |
| 4,407,419 | 10/1983 | Clements | 212/189 |

FOREIGN PATENT DOCUMENTS

| | | | |
|---|---|---|---|
| 048076 | 3/1982 | European Pat. Off. | 212/181 |
| 1021150 | 12/1957 | Fed. Rep. of Germany | 212/231 |
| 3007730 | 10/1981 | Fed. Rep. of Germany | 414/668 |
| 2509708 | 1/1983 | France | 212/189 |

*Primary Examiner*—Trygve M. Blix
*Assistant Examiner*—R. B. Johnson
*Attorney, Agent, or Firm*—Ronald C. Kamp; Richard B. Megley

[57] ABSTRACT

A retractable leg structure for undecking a crane's upper from its carrier including a box member having a circular cross section and a longitudinal axis affixed to the upper, a beam retained within the box and rotatable about the longitudinal axis relative thereto, and an L-shaped leg, including a tubular member having a free end hinged to the beam, the leg being manually swingable about the hinged connection between a stowed position in which the tubular member is oriented horizontal and inboard of the upper and a deployed position in which the tubular member is horizontal and outboard of the upper. There is a lock pin device for selectively securing the leg in one of the deployed and stowed positions, and an extendable jack secured to the fee end of the tubular member along with a crank arm attached to the beam. A hydraulic ram connected to the crank arm moves the leg between the deployed position and an operative position wherein the tubular member is oriented vertically adjacent to the ground.

7 Claims, 6 Drawing Figures

CRANE UNDECKING ARRANGEMENT

This application is a continuation of application Ser. No. 487,629, filed Apr. 22, 1983, now abandoned.

This invention relates to an undecking arrangement for cranes, and more particularly, to such an arrangement which utilizes short stroke jacks and is capable of compact stowage.

Figure 1:
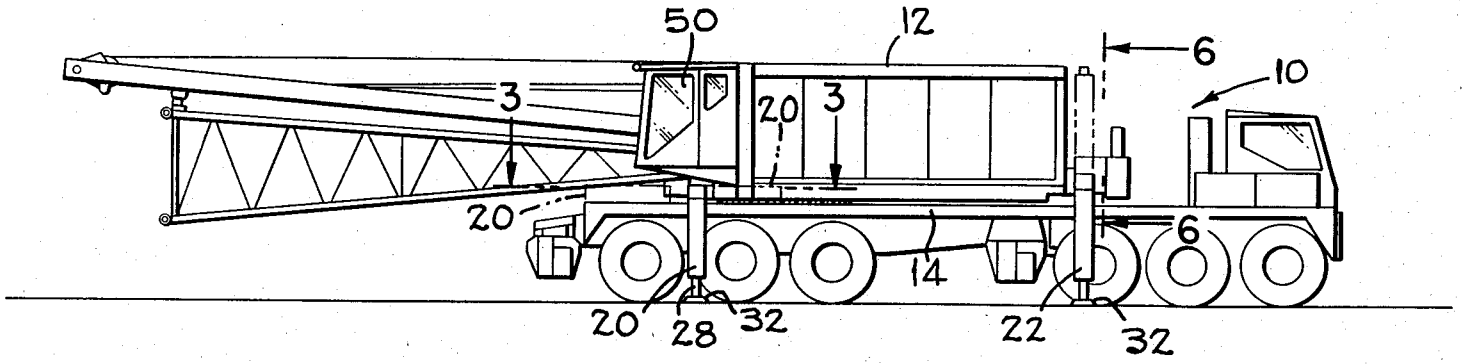
FIG. 1 is a side elevational view of a crane incorporating an undecking arrangement according to the present invention.
Figure 2:
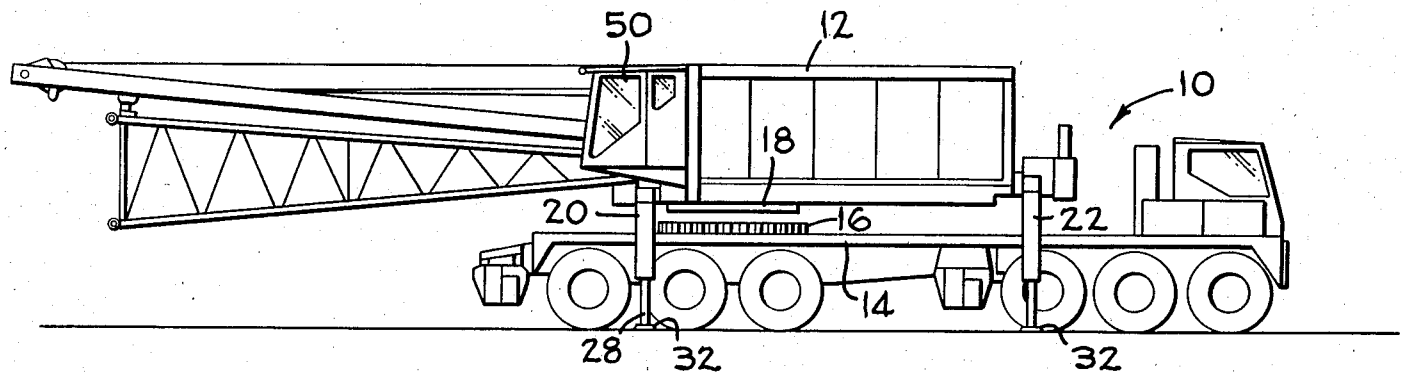
FIG. 2 is a side elevational view of the crane in FIG. 1 showing the upper undecked from the carrier.

Referring to FIGS. 1 and 2, a crane, indicated generally at 10, includes an upper 12 rotatably mounted on a lower works or carrier 14 by means of a turntable bearing 16. The turntable bearing 16 is releaseably secured to a ring 18 attached to the upper 12. A preferred means for releaseably securing the ring and turntable bearing is disclosed in U.S. Pat. No. 3,923,407 issued Dec. 2, 1975 to L. B. Jensen and R. E. Thune. A pair of front legs 20 are mounted on the front of the upper 12 and a pair of rear legs 22 are mounted on the rear thereof. Each of the pair of legs 20 and 22 is capable of spanning the transverse width of the carrier 14 and provide a structural means of supporting the upper 12 from the ground. Since each of the front pair of legs are similiar, as are each of the rear pair, a description of only one leg of each pair is necessary for a complete understanding of the invention.

Figure 3:
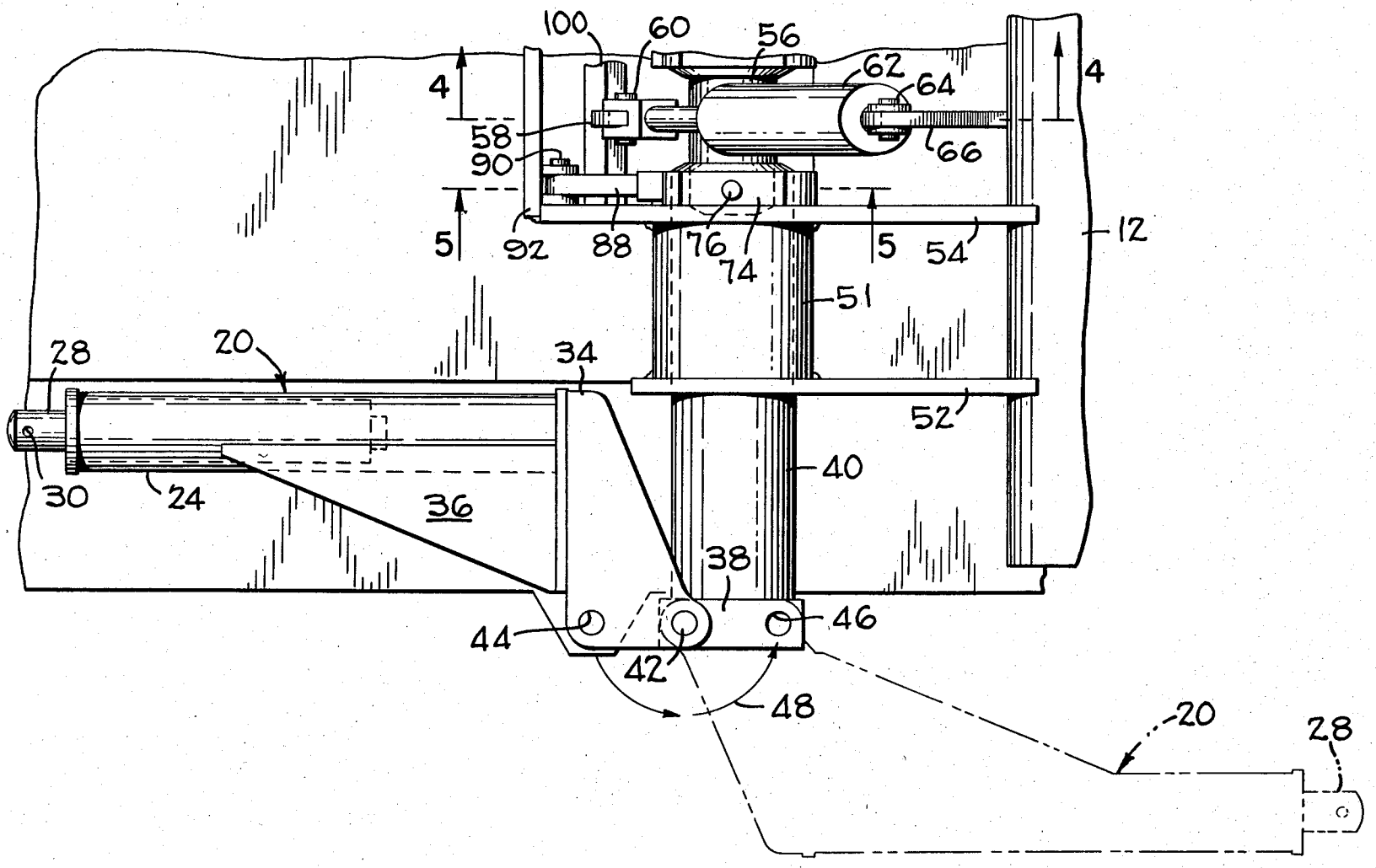
FIG. 3 is a view taken on line 3—3 of FIG. 1.

The front leg 20 includes a tubular portion 24 having a double-acting hydraulic ram or jack 26 affixed to the interior thereof. The rod 28 of jack 26 protrudes from one end of portion 24, has a cross bore 30 for attachment of a float or pontoon 32, as shown in FIGS. 1 and 2, for engagement with the ground, and is extendable to elevate the upper 12 as can be seen in FIG. 2. A transverse beam end 34 is affixed to the other end of portion 24 with a gusset 36 welded there between. The beam end 34 is pivotally mounted to a plate 38 secured to the free end of a round tubular beam 40 by means of hinge pin 42. The hinge pin 42 is oriented substantially vertical so that the leg 20 may swing in a horizontal plane between a stowed position, as shown by solid lines in FIG. 3, and a deployed or outward position, as shown by phantom lines. The beam end 34 is provided with a bore 44 that is alignable with a bore 46 provided in the plate 38. Insertion of a pin through the bores 44 and 46 rigidly secures the beam end 34 to the beam 40. The arrow 48 illustrates the movement of bore 44 as the leg 20 is manually pivoted between the solid line stowed position and the phantom line deployed position. In the stowed position the leg 20 is underneath the cab 50 of the upper, as shown in FIG. 1, with the tubular portion 24 extending forward, thereof, relative to the upper 12. In the deployed position, the leg 20 is positioned outboard and beside the cab 50 with the portion 24 extending rearward. While the leg 20 is heavy, the manual movement between stowed and deployed positions may be readily accomplished because only the friction forces around hinge pin 42 need be overcome.

Figure 4:
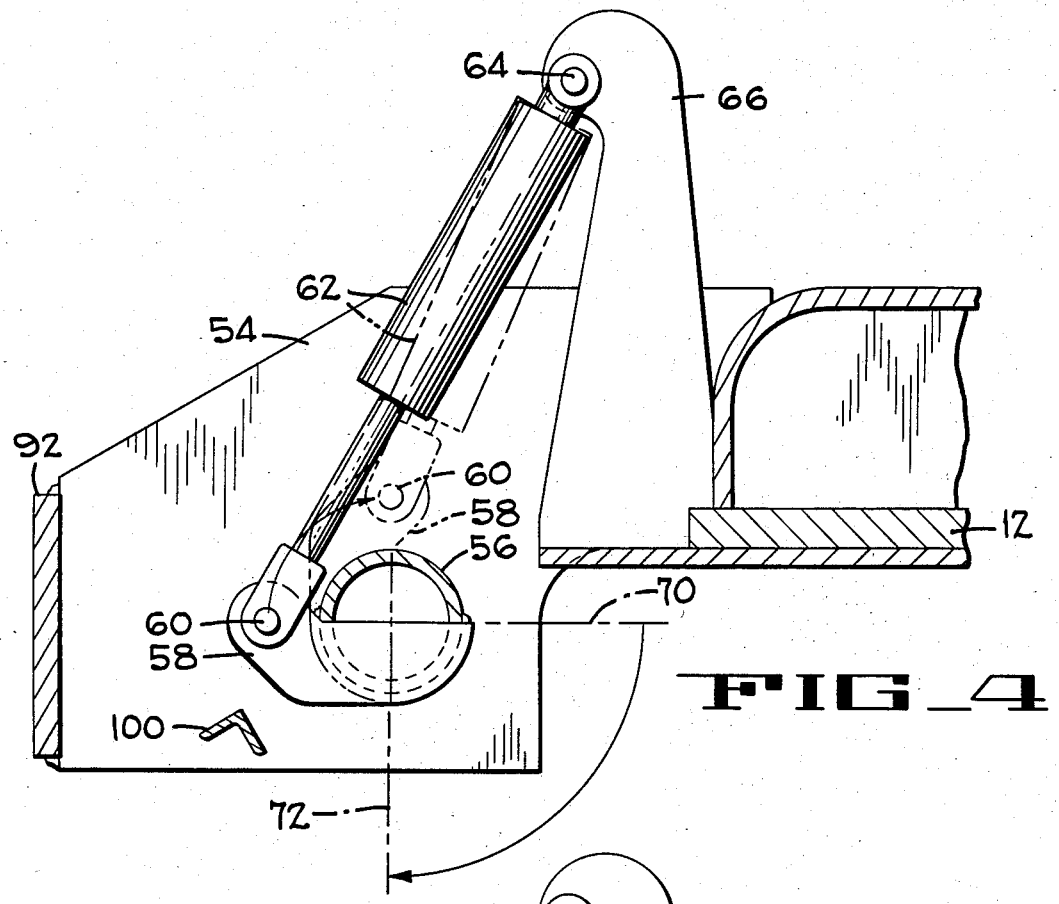
FIG. 4 is a cross-sectional view taken on line 4—4 of FIG. 3.
Figure 5:
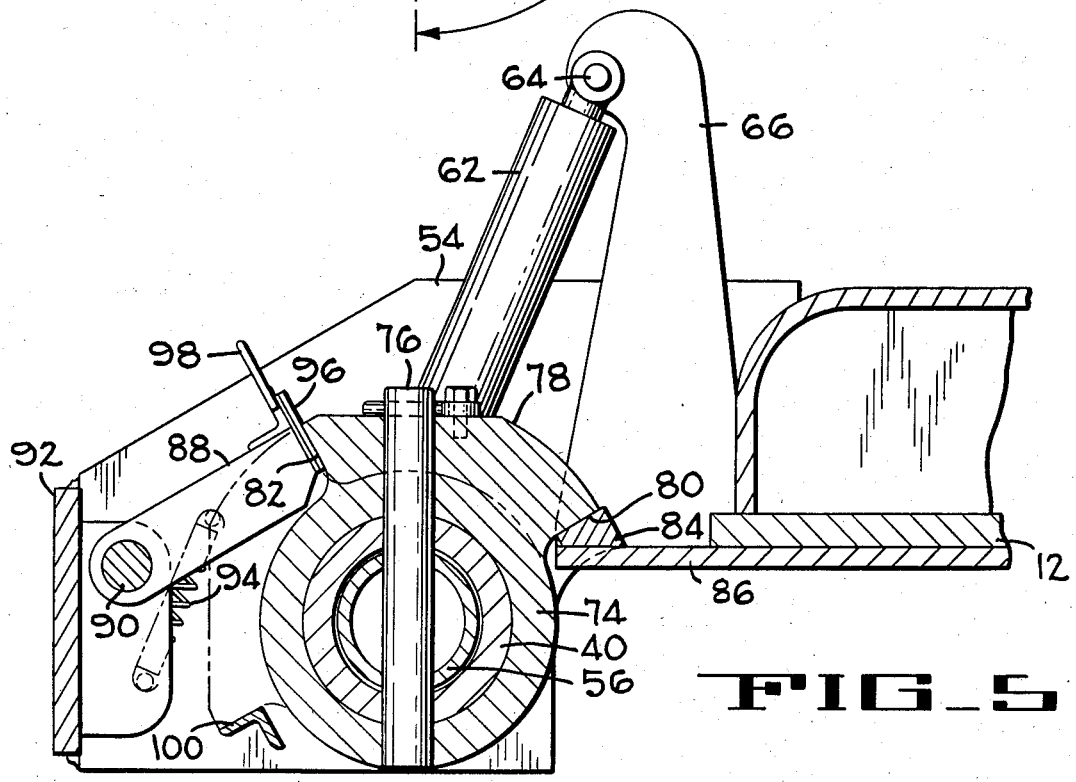
FIG. 5 is a cross-sectional view taken on line 5—5 of FIG. 3.

Once deployed and pinned through bores 44 and 46, the leg 20 must be rotated through 90 degrees to a vertical orientation. Such movement is provided by mounting the round beam 40 in a round box member 51 rigidly secured to the frame of the upper 12 through plate members 52 and 54. An actuating tube 56 is secured to, and extends between, the beam 40 and the comparable beam for the other of the pair of legs 20, effectively comprising a unitary beam extending across the width of the upper 12. A crank arm 58 is secured to the center of the tube 56 and is pinned at 60 to the clevis on the rod end of a double-acting hydraulic ram 62. The head end of ram 62 is pinned at 64 to a fixed bracket 66 rigidly secured to the upper 12. With the ram 62 extended, as shown in FIG. 4, the leg 20 will be in its deployed position; the center line of the leg 20 being indicated at 70. When the ram 62 is contracted, as shown in phantom lines therein, the leg 20 will be rotated to its vertical position; the centerline of the leg 20 now being indicated at 72.

In order to assure that the tubular portion 24 of leg 20 is vertically oriented and to remove the hydraulic load on the ram 62, a collar 74 engages the inner end of the round beam 40 and is arranged to function as a stop or motion limiter. The collar 74, round beam 40 and the actuating tube 56, are pinned into a unitary structure by a pin 76 inserted through aligned holes extending there through. A lug 78 formed on the collar 74 is provided with a pair of radially extending stop surfaces or faces 80 and 82. A wedge block 84 having a surface engageable with, and complementary to, the face 80 is secured to a structural member 86 of the upper 12. The wedge block 84 is pushed against the face 80 and welded to the member 86 when the legs 20 are vertically oriented with the upper 12 in a level position. The engagement of the face 80 with the wedge 84 thereafter positions the legs 20 correctly to support the weight of the upper. In addition, or in the alternative, shims may be attached to the wedge block to compensate for tolerance accumulations between the two front legs.

To lock the legs in this position, a pawl 88 is pivotally mounted by means of pin 90 to a plate member 92 affixed between plate member 54 and its corresponding member on the other side of the upper's longitudinal center line. The pawl 88 is biased by tension spring 94 toward engagement with the stop surface or face 82. When the face 80 engages the wedge block 84, the pawl 88 will snap into position engaging the face 82. Shims 96 may be secured to the free end of pawl 88, in order to reduce back lash and to lock the cross tube members so that the legs 20 are substantially vertical. Once the face 80 has engaged wedge block 84 and pawl 88 has engaged face 82, the legs 20 are locked in place mechanically, and the ram 62 is no longer necessary to maintain the legs vertical.

To return the legs 20 to their stowed position, the pawl 88 is manually lifted by means of handle 98 so that it is free of the lug 78 and the ram 62 is extended, causing the legs 20 to rotate to their deployed position. In this position the collar 74 and its lug 78 will have rotated until the face 82 engages the angle 100 secured between the plate 54 and its corresponding member on the other side of the upper center line. The pin that had been inserted through bores 44 and 46 is removed and the leg 20 pivoted on pin 42 from its deployed position to its stowed position. When in its stowed position, the center of gravity of the leg 20 tends to rotate the beam 40 in a counter clockwise direction, as viewed in FIG. 4. However, the engagement of the face 82 with the angle 100 will prevent rotation in that direction. With the angle 100 resisting such rotation, there is no hydraulic load on the ram 62 resulting from the restrain of such movement. Due to tolerance accumulation between the two front legs, it may be necessary to add shims to the angle 100 for engagement by the face 82 on one side in order that both front legs 20 will be stowed horizontally.

The rear legs 22 for supporting the upper 12 are pivotable between an upward and inboard stowed position, shown by phantom lines in FIG. 1, and an outward and downward operable position, shown by solid lines in FIGS. 1 and 2. The one leg 22, shown in FIG. 6, illustrates the leg in its stowed position in solid lines and in its operable position in phantom lines with the lower portion eliminated.

Figure 6:
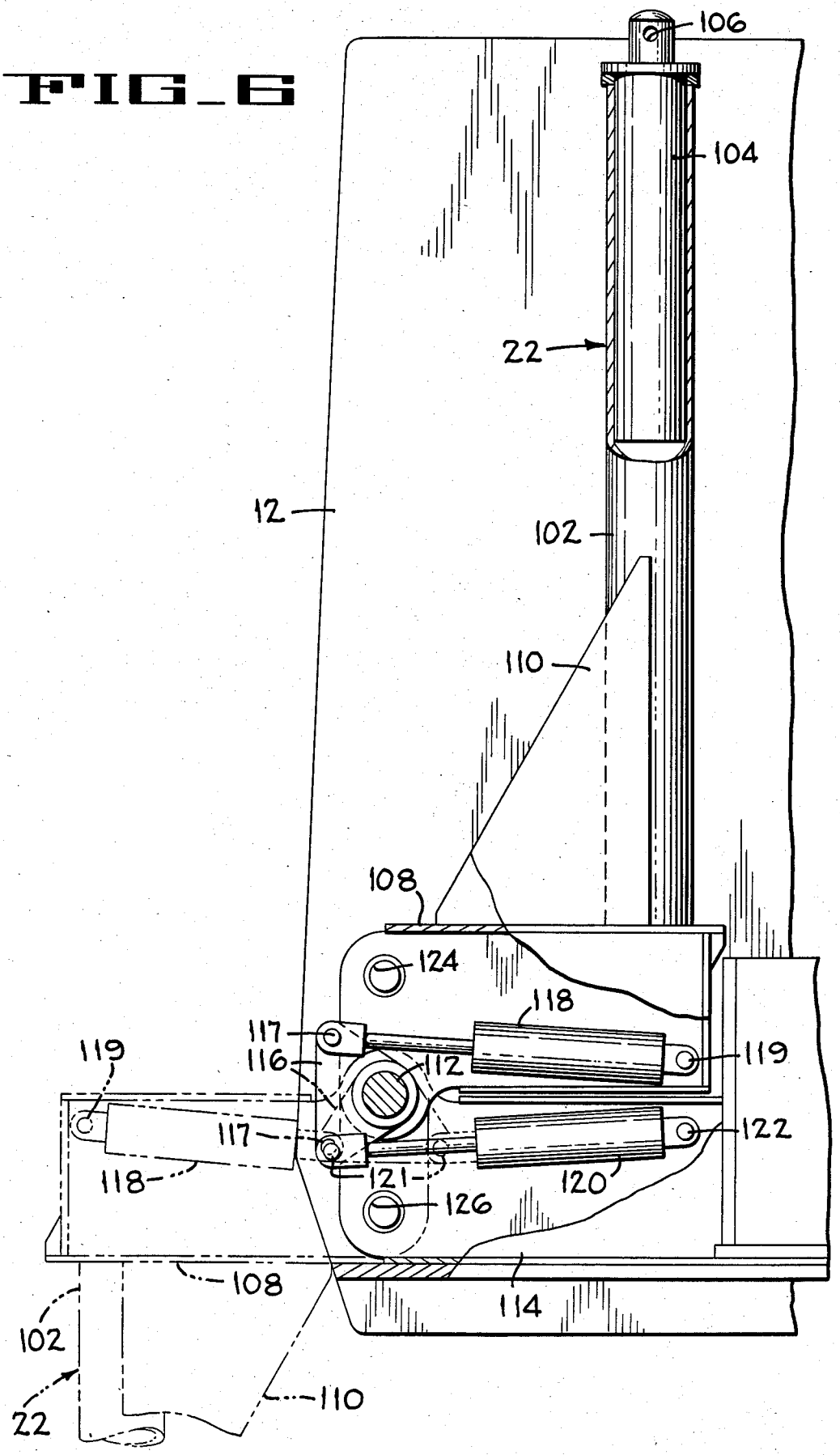
FIG. 6 is a view taken on line 6—6 of FIG. 1.

Referring now to FIG. 6, the rear leg 22 has a tubular member 102 with a double-acting jack 104 affixed to its interior. The rod of the jack has a cross bore 106 for attachment of a float or pontoon 32 when in its operable position. The tubular member 102 is attached to a beam end 108 with a gusset 110 secured there between for strength. The beam end 108 is preferably hollow and of rectangular cross section, and is pivotally connected by means of pin 112 to a rigid beam 114 affixed to, and extending across the width of the upper 12. A bellcrank 116 is rotatably mounted on the pin 112. A double acting hydraulic ram 118 has its rod end pivotally connected at 117 to the bell crank 116 and its head end pivotally connected at 119 to the beam end 108. A similar ram 120 has its rod end pivotally connected at 121 to the bell crank 116 on the opposite side of the pin 112 and its head end pivotally connected at 122 to the beam 114. With both of the rams 118 and 120 extended, as shown by solid lines—FIG. 6, the beam end 108 is substantially parallel with and overlies the beam 114. When both of the rams 118 and 120 are contracted, the beam end 108 is rotated counter clockwise, as viewed in FIG. 6, through approximately 180 degrees so that the beam end 108 and the beam 114 are aligned, with the tubular member 102 substantially vertical. The beam end 108 and beam 114 are then joined into a structural unit by insertion of a pin through then aligned bores 124 and 126 formed in the beam end 108 and the beam 114 respectively.

It will be seen from the foregoing description that the present invention provides a structural arrangement for the undecking of a crane upper which requires relatively short stroke jacks and the inherent disadvantages of long stroke jacks are thereby obviated. The legs may be folded compactly and with little physical effort against the crane upper into their stowed positions and do not inhibit or interfere with the normal operation of the crane.

While a preferred embodiment of the present invention has been shown and described herein, it will be apparent that various changes and modifications may be made therein without departing from the spirit of the invention as defined by the scope of the appended claims.

What is claimed is:

1. A retractable leg structure for undecking a crane's upper from its carrier comprising:

a first beam affixed to said upper;

a pin carried by said first beam;

a second beam pivotally attached to said pin;

a tubular member affixed said to second beam to define an L-shaped leg, said leg being moveable on said pin between a stowed position in which said tubular member is adjacent said upper and projects upward and a vertical operative position in which said tubular member is outboard of said upper and projects downward adjacent the ground;

a bell crank independently rotatable on said pin;

a first hydraulic ram having a first end pivotally attached to said first beam and a second end pivotally attached to said bell crank;

a second hydraulic ram having a first end pivotally attached to said second beam and a second end pivotally attached to said bell crank, whereby extension of both said rams will orient said leg in its stowed position and retraction thereof will orient said leg in its operative position;

an extendable jack member secured to said tubular member; and means engageable with said first beam assuring said tubular member is oriented vertically upon retraction of said rams.

2. The invention according to claim 1, and further comprising means to releaseably lock said leg in said operative position.

3. A retractable leg structure for undecking a crane's upper from its carrier comprising:

a box member having a circular cross section and a longitudinal axis affixed to said upper;

a beam retained within said box and rotatable about said longitudinal axis relative thereto;

an L-shaped leg, including a tubular member having a free end, hinged to said beam, said leg being manually swingable about said hinged connection between a stowed position in which said tubular member is oriented horizontal and inboard of said upper and a deployed position in which said tubular member is horizontal and outboard of said upper;

lock pin means for selectively securing said leg in one of said deployed and stowed positions;

an extendable jack secured to the free end of said tubular member;

a crank arm attached to said beam;

and a hydraulic ram pivotally attached at one end to said crank arm and at the other end to said upper for moving said leg between said deployed position and an operative position wherein said tubular member is oriented vertically adjacent the ground.

4. The invention according to claim 3 and further comprising:

a lug attached to said beam;

a block attached to said upper and engageable by said lug; and said block positioned so that it is engaged by said lug when beam is rotated to orient said leg in its operative position to assure said tubular member is oriented substantially vertically.

5. The invention according to claim 4 and further comprising:

a pawl pivotally mounted on said upper end engageable with said lug when said lug has contacted said block to lock said leg in its operative position.

6. The invention according to claim 5, and further comprising:

bias means connected between said upper and said pawl for urging said pawl toward engagement with said lug.

7. The invention according to claim 6, and further comprising:

stop means attached to said upper and positioned to engage said lug when said beam is rotated to orient said lug in said deployed position.

* * * * *